US010806267B1

(12) United States Patent
Aramli

(10) Patent No.: US 10,806,267 B1
(45) Date of Patent: Oct. 20, 2020

(54) MATTRESS MOUNT WITH A FOAM BLOCK

(71) Applicant: BEDJET LLC, Newport, RI (US)

(72) Inventor: Mark Darius Aramli, Newport, RI (US)

(73) Assignee: BedJet LLC, Newport, RI (US)

( * ) Notice: Subject to any disclaimer, the term of this patent is extended or adjusted under 35 U.S.C. 154(b) by 14 days.

(21) Appl. No.: 16/388,844

(22) Filed: Apr. 18, 2019

(51) Int. Cl.
*A47C 19/02* (2006.01)
*A47C 20/04* (2006.01)
*A47C 21/02* (2006.01)

(52) U.S. Cl.
CPC ..... *A47C 19/02* (2013.01); *A47C 20/048* (2013.01); *A47C 21/02* (2013.01)

(58) Field of Classification Search
CPC ..... A47C 19/02; A47C 19/021; A47C 19/022; A47C 20/048; A47C 20/14; A47C 21/02; A47C 21/026; A47C 21/028; A47C 21/04; A47C 21/042; A47C 21/044; A47C 21/06; A61G 7/012; A61G 7/018; A61G 7/05; A61G 7/0506; A61G 7/0519; A61G 7/075; A61G 7/1019; A61G 7/0504; A61G 7/0514
See application file for complete search history.

(56) References Cited

U.S. PATENT DOCUMENTS 3,848,283 A * 11/1974 Ikeda ..... A47C 27/05 5/717
4,276,667 A * 7/1981 Osbourne ..... A47C 21/022 24/72.5
5,033,139 A * 7/1991 Renfro ..... A47C 21/022 24/72.5
7,631,377 B1 * 12/2009 Sanford ..... A47C 21/044 5/413 R
8,918,931 B1 * 12/2014 Baker ..... A47C 21/022 5/498
2003/0150060 A1 * 8/2003 Huang ..... A47C 21/044 5/726
2005/0278863 A1 * 12/2005 Bahash ..... A01K 1/0353 5/726
2016/0193099 A1 * 7/2016 Drake ..... A61G 13/125 5/624
2017/0196367 A1 * 7/2017 Aramli ..... A47C 21/044
2017/0340128 A1 * 11/2017 Aramli ..... A61F 7/00
2018/0125259 A1 * 5/2018 Peterson ..... A47C 31/003
2020/0113343 A1 * 4/2020 Staels ..... B60N 2/5621
2020/0121093 A1 * 4/2020 Sipherd ..... A47C 21/026

* cited by examiner

*Primary Examiner* — Robert G Santos
*Assistant Examiner* — George Sun
(74) *Attorney, Agent, or Firm* — Robert J. Hess; Hess Patent Law Firm

(57) ABSTRACT

A mattress mount that has a paddle, a riser and an air conduit clamp. The riser spaces the paddle apart from the air conduit clamp at different elevations. A compressible, resilient cushion is secured to a flat surface of the paddle. The paddle with cushion is positioned underneath a mattress to compress the cushion. The paddle extends from the riser to terminate at ta free end. The air conduit claim extends outwardly from the riser to terminate at free ends. The paddle and the air conduit clamp extend at different elevations and in opposite directions from the riser to terminate at their respective free ends.

12 Claims, 5 Drawing Sheets

MATTRESS MOUNT WITH A FOAM BLOCK

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

1. Field of the Invention

The invention relates to a mattress mount unit that is equipped with a paddle, to which is adhered a compressible/expandable foam block, a riser having height extending links that extend upward from the paddle and an air conduit clamp projecting from a distal end of the riser.

2. Description of Information Known to the Inventor, Including References to Specific Documents Related to the Invention, and Specific Problems Involved in the State of Technology that the Invention is Drawn Toward The entire contents of U.S. Pat. No. 9,723,932 are incorporated herein by reference. Normally the weight of the mattress is constant and holds the mattress mount paddle in place under the mattress. Such a mattress mount paddle was constructed in accordance with the underlying mattress portion of the mattress mount unit of U.S. Pat. No. 9,723,932 that is equipped with height extending links that adjust a riser distance between a base (paddle) and an air conduit clamp.

The use of the mattress mount unit for some adjustable beds is problematic, such as where the weight of the mattress on the paddle sometimes shifts or even releases with movement of the adjustable bed frame. Often the mattress doesn't conform perfectly to the leg-lifting portion of the adjustable bed frame after lift. As a consequence, the weight of the mattress is eliminated as an effective holding force and such creates a gap in exactly the area that the mattress mount paddle was typically placed (at the foot of the bed). With some very stiff mattresses, this would cause the mattress mount (constructed in accordance with U.S. Pat. No. 9,723,932) to move around over time or fall out.

It would therefore be desirable to in effect lock in place the mattress mount unit, without forming a bump under the mattress.

SUMMARY OF THE INVENTION

One aspect of the invention resides in a compressible/expandable foam block adhered to an underside of a mattress mount paddle and that slides under a mattress into position. Because the foam is compressed when under the mattress, the mattress mount paddle is equipped, by virtue of the compressible/expandable block, to accommodate increases in the size of variable gaps between the mattress and mattress platform/bedframe that may be caused by adjustable bed frames lifting the leg portion of the bed (the foam just expands to fill the gap). As a consequence, the compressible/expandable foam block provides the paddle with a tighter and harder to move mounting point than without and further does so without creating a significant bump under the mattress.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE INVENTION

Figure 1:
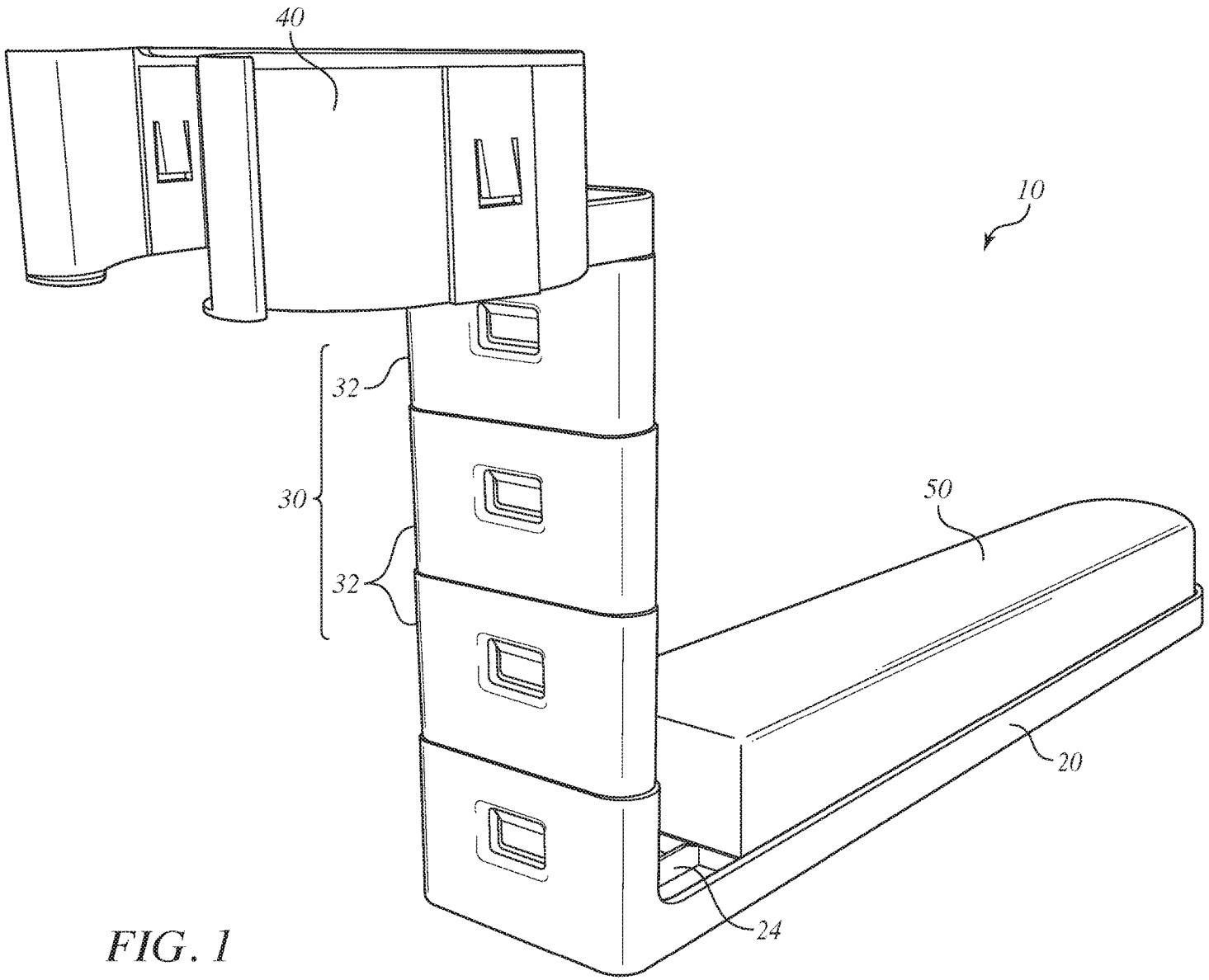
FIG. 1 is a front isometric view of a mattress mount in accordance with the invention that is equipped with a paddle to which is adhered a foam block, a riser that extends from its proximal end upwardly from an end of the paddle and an air hose clamp that projects outwardly from a distal end of the riser.

Turning to the drawings, FIG. 1 shows a mattress mount unit 10 in accordance with the invention. The mattress mount unit 10 includes a paddle 20, a riser 30, and an air hose clamp 40. To that extent, the mattress mount unit 10 is analogous to the mattress mount unit of U.S. Pat. No. 9,723,932 in that both are equipped with height extending links that adjust a riser distance between a base (paddle) and an air conduit clamp.

Figure 2:
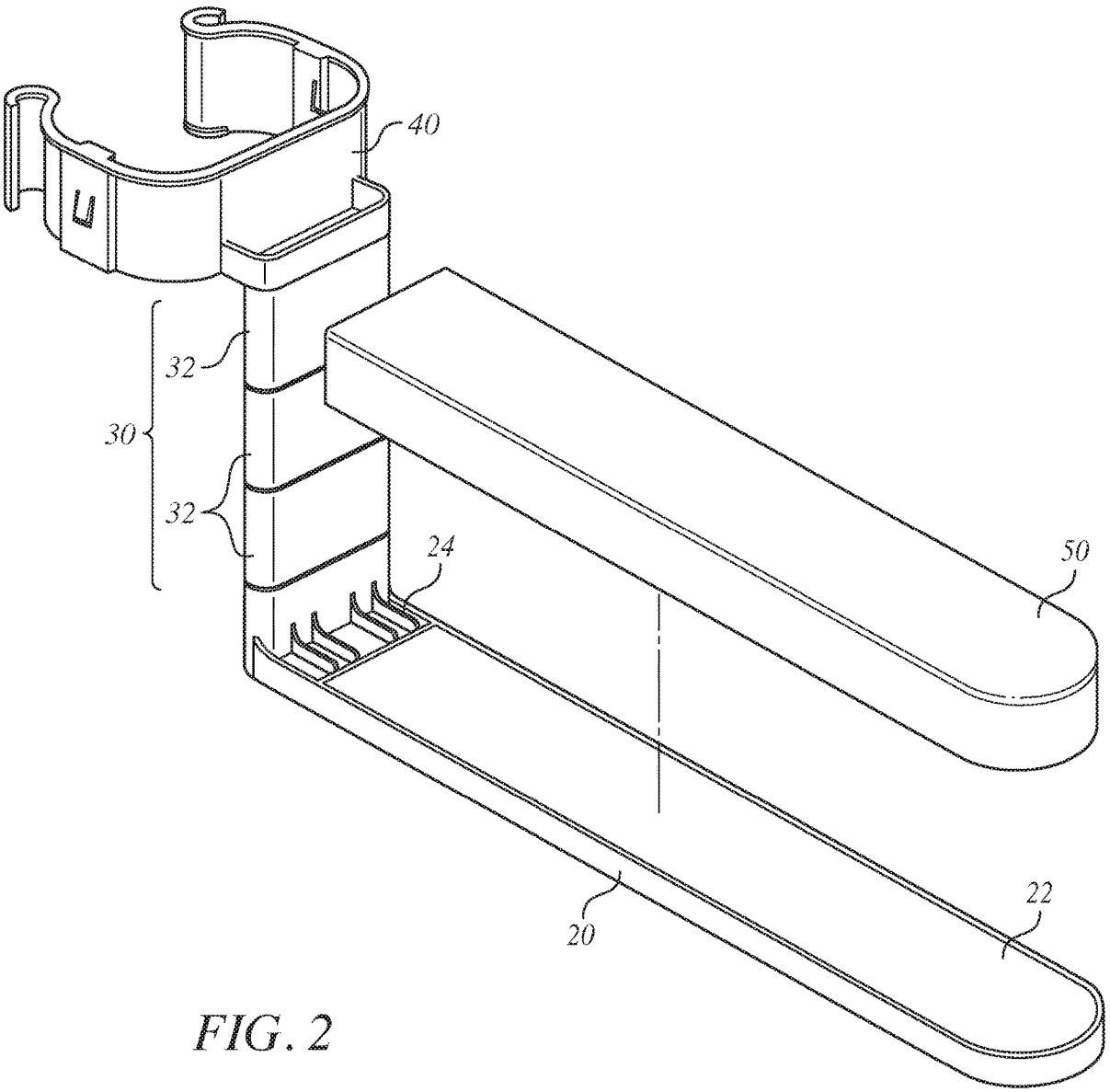
FIG. 2 is an exploded and rear isometric view to that of FIG. 1 that shows the foam block separate from the paddle prior to adhering the foam block to the paddle.
Figure 3:
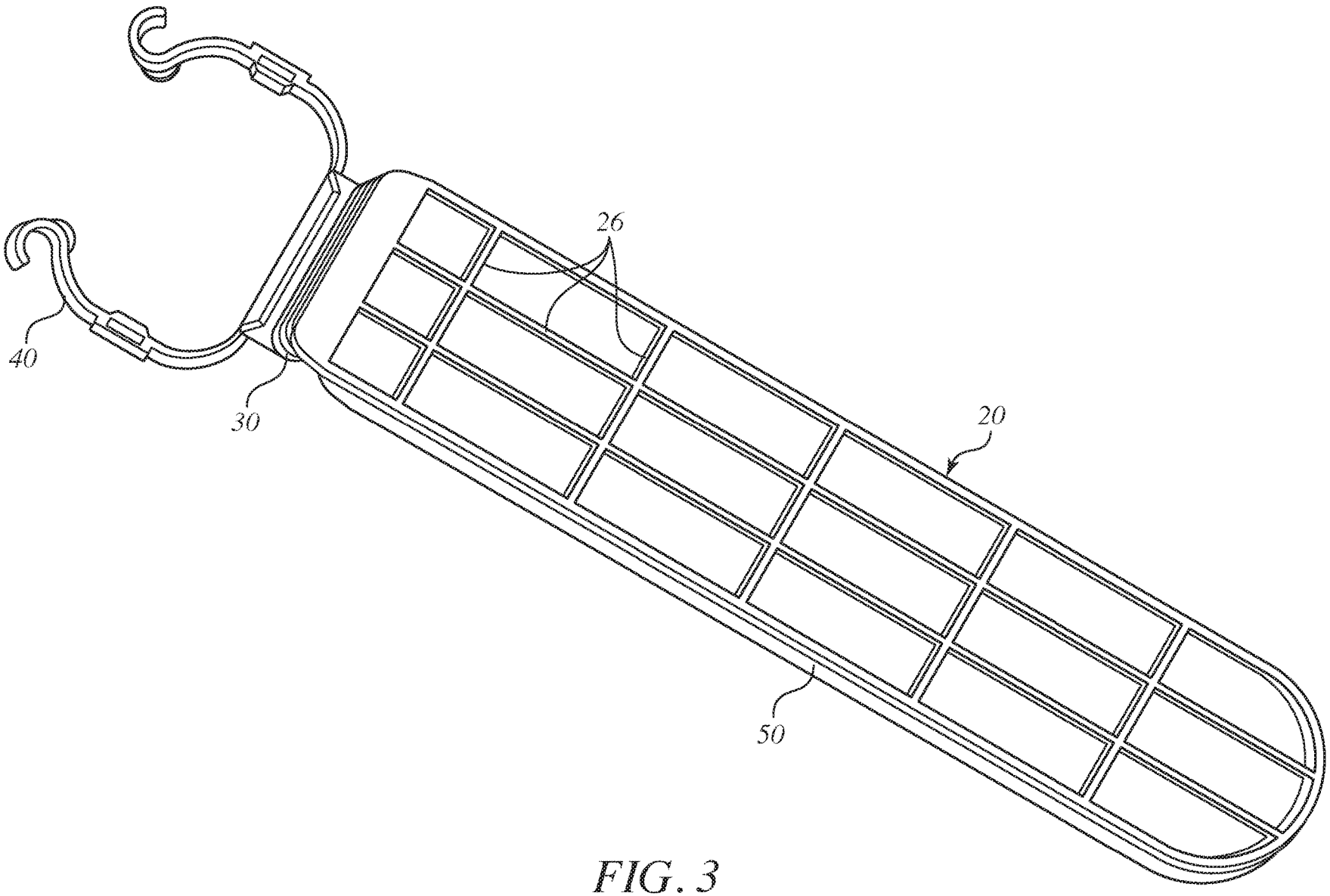
FIG. 3 is a bottom isometric view of the mattress mount of FIGS. 1 and 2.
Figure 4:
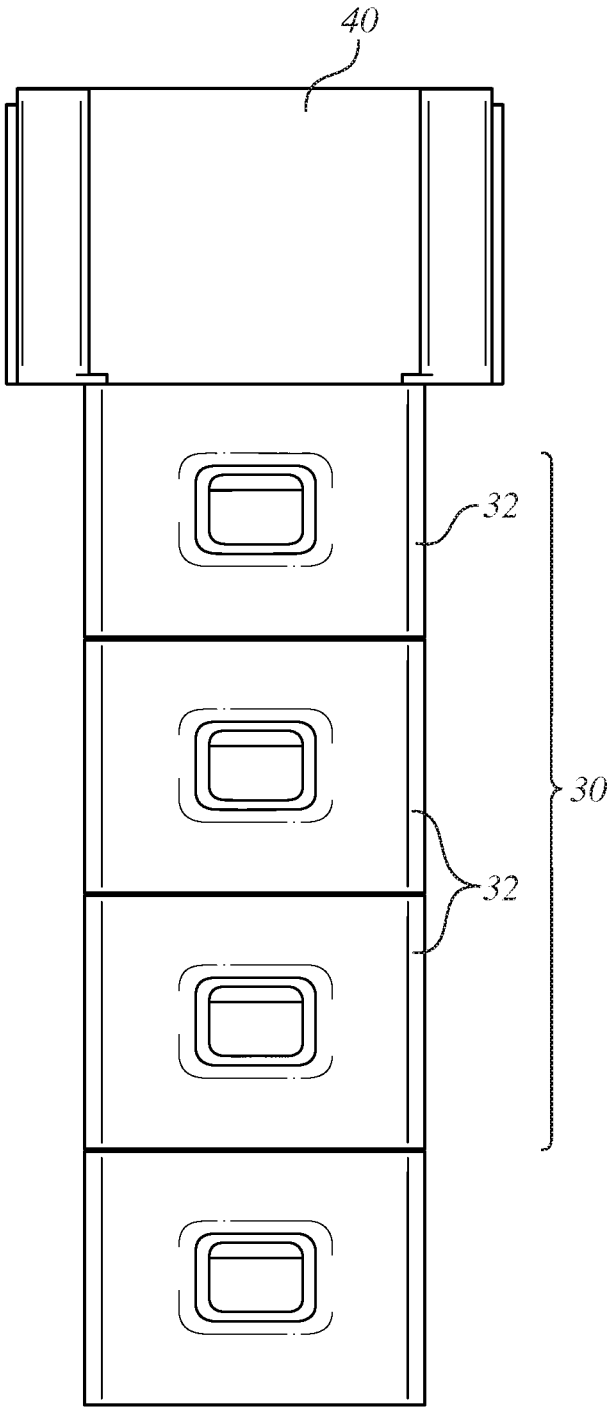
FIG. 4 is a front plan view of the mattress mount of FIGS. 1-3.
Figure 5:
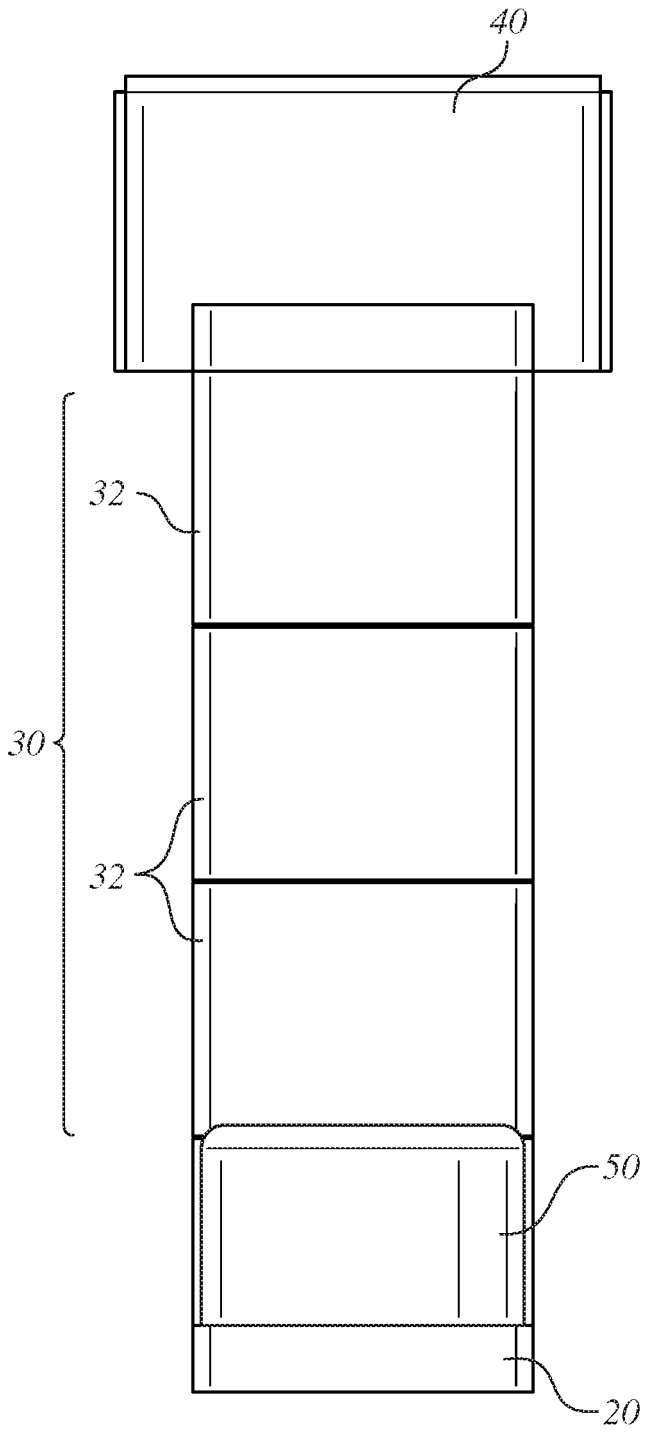
FIG. 5 is a rear plan view of the mattress mount of FIGS. 1-4.

However, the construction of the paddle 12 differs from that of the construction of the base of U.S. Pat. No. 9,723,932. Instead, the paddle 20 in according to FIGS. 2 and 3 has a smooth top surface 22 into which is to be seated (via an adhesive) a foam block 50. Between the smooth top surface 22 and the lowermost height extending links 32 of the riser 30 are topside ribs 24. The topside ribs 24 are substantially parallel to each other. The underside of the paddle 20 has an underside, ribbed structure 26. The ribbed structure 26 has a plurality of ribs intersecting each other in a grid-like pattern. The topside ribs 24 and the underside, ribbed structure 26 enhance stability within the paddle 20 over what would otherwise be the case without them.

The mattress mount 10 in use is placed underneath a foot-side region of a mattress and atop a flat surface such as a box spring or paddle bed flat surface. As a result, pressure is applied that compresses the foam block 50 and thereby helps retain the paddle 12 in position. The foam block 50 has resilient memory so that it seeks to return to its non-compressed condition. For instance, the foam block 50 under compression accommodate increases in the size of variable gaps between the mattress and mattress platform/bedframe that may be caused by adjustable bed frames lifting the leg portion of the bed. This is because the foam just expands to fill the gap.

While the foregoing description and drawings represent the preferred embodiments of the present invention, various changes and modifications may be made without departing from the scope of the present invention.

What is claimed is:

1. A mattress mount, comprising:

a paddle that has a surface and is elongated to extend from a proximal end to a free end where the paddle terminates;

a riser extending from the proximal end of the paddle to reach a higher elevation than that of the paddle;

an air conduit clamp protruding outward from the riser at the higher elevation reached by the riser, the air conduit clamp and the paddle extending at different elevations and in opposite directions away from the riser; and a resilient, compressible foam block secured to the surface of the paddle, wherein the resilient, compressible foam block is compressed under a mattress into a compressed condition yet resiliently expands from the compressed condition to fill gaps otherwise that arise over time between the resilient, compressible foam block and the mattress.

2. The mattress mount of claim 1, further comprising:

a plurality of ribs that extend parallel to each other between the surface of the paddle and the riser.

3. The mattress mount of claim 1, wherein the paddle has an underside with a plurality of ribs intersecting each other in a grid pattern.

4. The mattress mount of claim 1, wherein the resilient, compressible foam block is adhered to the surface of the paddle.

5. The mattress mount of claim 1, wherein the riser includes a plurality of height extending links that are releasably engaged with each other one over another.

6. A method of assembling a mattress mount, comprising:

compressing a resilient foam block that is secured to a surface of a paddle;

extending a riser upwardly from a proximal end of the paddle to reach a higher elevation than that of the paddle, the paddle being elongated to extend from the proximal end and terminate at a free end;

protruding an air conduit clamp outward from the riser at the higher elevation reached by the riser, the air conduit clamp and the paddle extending at different elevations and in opposite directions away from the riser; and compressing the foam block into a compressed condition under a mattress yet resiliently expanding portions of the mattress from the compressed condition to fill gaps otherwise that arise over time between the foam block and the mattress.

7. The method of claim 6, further comprising:

extending a plurality of ribs parallel to each other between the surface of the paddle and the riser.

8. The method of claim 6, further comprising:

equipping an underside of the paddle with a plurality of ribs intersecting each other in a grid pattern.

9. The method of claim 6, further comprising:

adhering the foam block to the surface of the paddle.

10. The method of claim 6, wherein the riser includes a plurality of height extending links, further comprising:

releasably engaging the height extending links with each other one over another.

11. A method of assembling a mattress mount, comprising:

compressing a resilient foam block that is secured to a surface of a paddle;

extending a riser upwardly from a proximal end of the paddle to reach a higher elevation than that of the paddle, the paddle being elongated to extend from the proximal end and terminate at a free end;

protruding an air conduit clamp outward from the riser at the higher elevation reached by the riser, the air conduit clamp and the paddle extending at different elevations and in opposite directions away from the riser; and accommodating increases in a size of variable gaps between the mattress and a mattress platform by allowing the compressed foam block to expand to fill the gaps.

12. A method of assembling a mattress mount, comprising:

compressing a resilient foam block that is secured to a surface of a paddle;

extending a riser upwardly from a proximal end of the paddle to reach a higher elevation than that of the paddle, the paddle being elongated to extend from the proximal end and terminate at a free end;

protruding an air conduit clamp outward from the riser at the higher elevation reached by the riser, the air conduit clamp and the paddle extending at different elevations and in opposite directions away from the riser; and accommodating increases in a size of variable gaps between the mattress and a mattress bedframe by allowing the compressed foam block to expand to fill the gaps.

* * * * *